United States Patent [19]

Shores

[11] 4,206,707

[45] Jun. 10, 1980

[54] ELECTROMAGNETIC HAZARD SUPPRESSION TECHNIQUES

[75] Inventor: Marvin W. Shores, Pomona, Calif.

[73] Assignee: General Dynamics Corportation, Pomona, Calif.

[21] Appl. No.: 854,434

[22] Filed: Nov. 22, 1977

[51] Int. Cl.[2] ..... F42B 5/08

[52] U.S. Cl. ..... 102/46

[58] Field of Search ..... 102/28 R, 28 M, 46, 102/203

[56] References Cited

U.S. PATENT DOCUMENTS

| | | | |
|---|---|---|---|
| 2,658,451 | 11/1953 | Horne | 102/28 R |
| 2,887,054 | 5/1959 | Bryan | 102/28 R |
| 2,974,590 | 3/1961 | Ramer | 102/28 R |
| 3,009,419 | 11/1961 | Clay, Jr. et al. | 102/28 R |
| 3,019,732 | 2/1962 | Kaspul | 102/28 R |
| 3,090,308 | 5/1963 | Paschoud | 102/28 R |
| 3,094,932 | 6/1963 | Greenlees | 102/28 R |
| 3,180,262 | 4/1965 | Talley et al. | 102/28 R |
| 3,333,538 | 8/1967 | Schnettler | 102/28 R |

*Primary Examiner*—Charles T. Jordan

*Attorney, Agent, or Firm*—Henry M. Bissell; Edward B. Johnson

[57] ABSTRACT

Apparatus for protecting the primers of electrically ignitable ammunition from accidental firing due to electrostatic charge build up and electromagnetic radiation. In one arrangement, the insulation between the primer cap and the metal case of the ammunition round is short-circuited with a conductive coating which covers the primer and base of the round. In a second arrangement, a conductive coating is used in the same fashion, but it is applied over a previously applied dot of non-conductive paint which covers a small area encompassing the primer and adjacent portion of the cartridge casing. Still another arrangement utilizes a circular metal foil affixed across the base of the casing with conductive cement that is applied only along the outer periphery. If desired, the metal foil may be supported on a protective layer of Mylar or the like.

22 Claims, 13 Drawing Figures

ELECTROMAGNETIC HAZARD SUPPRESSION TECHNIQUES

The Government has rights in this invention pursuant to Contract No. N00024-77-C-7075 awarded by the Department of the Navy.

BACKGROUND OF THE INVENTION

1. Field of the Invention

This invention relates to safety devices, and more particularly to arrangements for protecting electrically fired ammunition or the like from premature or undesired ignition due to electrostatic charge or electromagnetic radiation.

2. Description of the Prior Art

It has long been known that the firing of ammunition by electrical ignition provides certain advantages over the percussion method. Electrical ignitors for ammunition provide shorter detonation times and are more reliable. The proportion of misfires is greatly reduced; in fact, misfiring is virtually eliminated, particularly where a combination electrical and percussion type primer is used which has the capability of igniting the primer by percussion if the electrical ignition system should malfunction. Because of these advantages, electrically fired ammunition is often preferred, particularly by the military, in those weapon systems which admit of adaptability to electrically fired ammunition. The Phalanx close-in weapon system of the U.S. Navy is one such installation. Examples of prior art disclosing electrically fired ammunition may be found in U.S. Pat. Nos. 690,268 of Gortz, 3,815,507 of Irish et al, and 3,844,216 of Jakobs et al, and in the German Pat. No. 2,245,308 and the French Pat. No. 2,231,945.

With the advent of electrically fired ammunition, there is the increased hazard of accidental firing due to the presence of sufficient ambient electrical energy to set off the ignitor. In some instances, the energy required for ignition may be as low as a few hundred ergs. Sufficient ambient energy to ignite electrically fired ammunition may be common in certain environments where systems using such ammunition are installed—e.g. radar-controlled guns—or from the build up of electrostatic charges in personnel or facilities which handle the ammunition. The recognition of this problem is also of long standing and examples in the prior art of various approaches for dealing with it may be found in the U.S. Pat. Nos. 1,959,479 of Kielczewski, 2,916,994 of O'Neill (shielding for electric blasting caps), 3,018,732 of Tognola, and 3,618,523 of Higuera.

In the Phalanx weapon system, for which the present invention was specifically developed, particular measures have been taken to guard against the accidental or inadvertent firing of the electrically ignited ammunition used in that system. The 20 mm ammunition which is employed is protected against ignition by electrostatic discharge and by electromagnetic radiation by virtue of a specially devised clip device, called the RADHAZ (for radiation hazard) clip to correct the problem. This clip is designed to keep the ignition electrode grounded when the ammunition is in storage. In preparation for use, the ammunition is transferred to a belt which transports the ammunition from the magazine drum to the actual weapon for firing. During this transfer step, special protection means are provided through the use of grounding fingers which ride along the ignitor electrodes of the individual rounds of ammunition. Despite these elaborate and specifically devised techniques, recent testing has revealed that the 20 mm round with the RADHAZ clip is vulnerable to radiation frequencies common to the Phalanx environment. In addition, during the same test program, the round was found to be vulnerable to ignition while in the flexible chute belt (without the RADHAZ clip) that feeds the rounds from the magazine drum to the gun breech.

SUMMARY OF THE INVENTION

In brief, arrangements in accordance with the present invention provide means for covering the butt or base end of the ammunition round with a conductive film or layer which prevents either electrostatic charge or electromagnetic radiation from reaching the primer cap. Together with the shell casing, this conductive film provides a complete shield totally encasing the primer cap. In some instances, the primer cap may also be conductively connected to the metal casing by the conductive film which contacts the primer cap surface as well as the butt end of the metal casing.

In one particular arrangement in accordance with the invention, the butt end of the ammunition round is coated with a conductive coating such as a conductive paint, which is affixed to both the primer cap and the surrounding portion of the metal case, thus bridging the insulation between the primer cap and the metal case. This coating is selected to provide an ohmic leakage factor of approximately ten times the resistance of the primer cap, or about ten ohms in the case of a primer resistance of one ohm. Thus, when the firing charge is applied to the primer cap by the firing pin within the gun, only about 10% of the current will bypass the primer cap, an amount which does not detract from the normal operation of the electrical ignitor circuit.

In another particular arrangement in accordance with the present invention, the same type of conductive coating is applied as before, except that the coating is insulated from the primer by the application of an undercoat of non-conductive paint. This undercoat or insulating layer of non-conducting paint is applied over a smaller area which includes the primer cap, the insulation ring surrounding it, and the adjacent part of the metal casing. The outer circumferential portion of the metal casing is, however, not coated with the insulating layer so that the conductive coating is electrically connected to the casing all around the perimeter, thus providing an all encompassing shield. Since this conductive coating is not in contact with the primer cap, there will be no diversion of firing current from the primer. There would initially be a burn-back of the conductive coating immediately surrounding the firing pin as the pin penetrates the conductive coating to contact the primer cap for ignition.

In a third arrangement in accordance with the present invention, a conductive metal foil is applied to the butt of the ammunition round as the conductive coating. This foil is electrically connected and affixed to the base of the round by a ring of conductive cement about the outer periphery thereof. The foil may or may not be in electrical contact with the primer cap. Foil thickness is selected so that the foil layer fuses open with the application of the firing pulse. For physical protection and greater strength, the foil layer may be mounted on a supporting flexible membrane, such as Mylar or some other suitable plastic. The Mylar would preferably be the outermost layer at the base of the round, for maximum protection, and may, if desired, by apertured or webbed in order to permit electrical contact with the foil as the round is being handled in preparation for firing in the gun.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
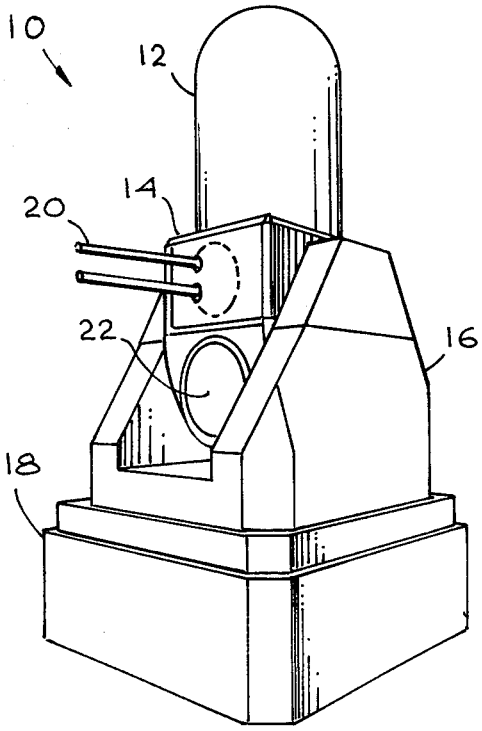
FIG. 1 is a perspective view of the Phalanx weapon system installation for which the present invention was developed.

It may help toward an appreciation of the significance of the present invention to briefly describe the Phalanx weapon system and the particular 20 mm ammunition employed therein. FIG. 1 shows a typical Phalanx system as installed on the deck of a naval vessel. The Phalanx system 10 is an all-weather automatic gunfire control system used by the U.S. Navy for defense against close-in air and surface threats which penetrate outer defenses. As shown in FIG. 1, the system 10 principally comprises a radome 12 mounted on top of a pivotable gun assembly 14 which is rotatably mounted to a mount and train drive assembly 16 supported on a base 18 housing various power supplies and control mechanisms.

The gun assembly 14 has a series of six 20 mm gun barrels 20 which rotate relative to a breech mechanism for firing in Gatling gun fashion. The gun assembly 14 also includes a magazine drum 22 in which the ammunition is placed in preparation for use and from which the rounds are transported to the breech mechanism by means of a chute belt (not shown).

By virtue of the mounting arrangement of the gun assembly 14 in the Phalanx system 10, gun barrels 20 may be aimed through various degrees of elevation and azimuth to fire at and destroy any enemy target within range.

Figure 2:
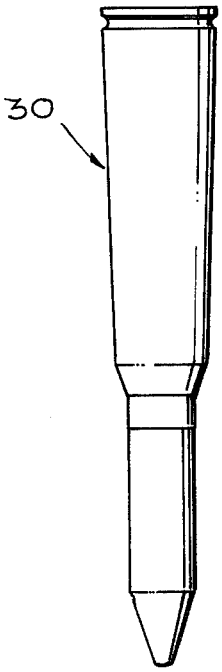
FIG. 2 is a side view of a 20 mm round of ammunition, used in the Phalanx system and other military applications, to which the present invention is directed.
Figure 3:
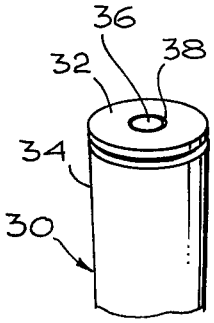
FIG. 3 is a perspective view of the rearward or base portion of the round of FIG. 2.

FIG. 2 shows a typical 20 mm round of ammunition of the type used in the Phalanx and in other military systems. To achieve the extreme rate of fire (several thousand rounds per minute) of which these systems are capable, the round is provided with a primer cap for electrical ignition. As shown in FIG. 3, which illustrates the rearward, base or butt end of the round 30, the base 32 presents a flat surface integrally formed with the round casing 34. In the center of the base 32 is a hole in which the primer cap 36 is inserted. A ring of insulation 38 is positioned between the primer cap 36 and the base 32 to maintain electrical isolation between the two. In the gun breech, the casing 34 is grounded and the primer 36 is ignited by applying a firing pulse of about 300 volts to the primer cap 36 from a firing pin that is driven against the primer cap 36.

From FIG. 1, it will be appreciated that the ammunition placed in the magazine drum 22 and in transit to the breech of the gun assembly 14 will be in an extreme electromagnetic radiation environment. The radar antennas for the weapon system are position within the radome 12, immediately above the gun assembly 14. The ammunition is within the gun assembly 14 and in the magazine drum 22 immediately below. This electromagnetic radiation is microwave energy at frequencies in excess of 5 GHz. As previously mentioned, tests have shown that other specific protection apparatus for the ammunition used in the Phalanx system has not provided adequate protection against accidental or inadvertent firing of the ammunition outside the breech of the gun due to electromagnetic radiation or possibly to the buildup of electrostatic charge. Moreover, it occasionally happens that a round goes through the gun without being fired. The expended casings and, in the event of a misfire, live rounds are returned to the magazine drum 22. There is the possibility that these rounds may explode in the magazine from the high level of ambient electromagnetic radiation. The various arrangements of the present invention not only protect against unwanted firing of the ammunition before it enters the gun breech, but also against the firing of unfired rounds which may be returned to the magazine. This is achieved in accordance with the invention by virtue of an electrical shield of limited extent which is applied to each round individually and which remains with the round before, during and after the round passes through the gun.

First Embodiment

Figure 4A:
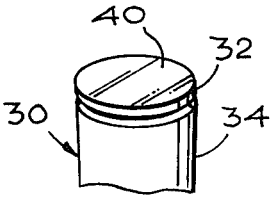
FIGS. 4A and 4B are respectively a perspective view and a side view of the rearward portion of the round of FIG. 2, showing one particular arrangement in accordance with the invention.
Figure 4B:
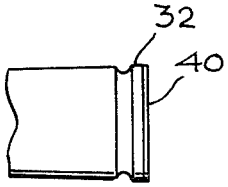

FIGS. 4A and 4B illustrate a first particular arrangement in accordance with the invention wherein the rearward surface of the round 30 having a metallic casing 34 is coated with a layer of conductive paint 40 which completely covers and bridges over the primer cap 36 and insulation ring 38. There is thus provided a conductive layer closing over the electrical discontinuity of the base 32 occasioned by the opening in the center thereof for the primer cap 36. Static charge which might otherwise might build up between the two electrodes (the primer cap 36 and the casing 34) is bled off through the conductive coating of the paint layer 40 before it reaches a level at which inadvertent firing could occur. Any charge of static electricity brought into contact with the round by a person or machine handling same will be partially conducted to ground through the conductive layer 40, thus reducing the amount of current through the primer. The conductive layer 40 also acts as a shield, together with the casing 34, against electromagnetic radiation, thus blocking such ambient energy from the primer cap 36. In this regard, and because of the extremely high frequency of the microwave radiation involved with the Phalanx system (5 GHz or more) a "skin effect" prevents the radiation from penetrating within the conductive layer 40 more than a very limited depth below the outer surface thereof. This phenomenon is well-known and is described, for example, in the "Radio Engineers' Handbook" by F. E. Terman (McGraw-Hill 1943) at pages 30 ff.

Conductive paint such as is suitable for use in the present invention is well-known in the art. Materials which are suitable comprise graphite or carbon black applied in suspension in a liquid medium with suitable binders. The resulting dried film typically has a thickness of from 0.5 to 2 mils and, as mentioned hereinabove, preferably provides a resistance between primer 36 and casing end 32 of about 10 ohms, for a primer cap having a resistance of 1 ohm.

It will be understood that the relative dimensions depicted in FIG. 4B and in corresponding figures described hereinbelow showing various other embodiments of the invention are exaggerated for purposes of illustration.

Second Embodiment

Figure 5A:
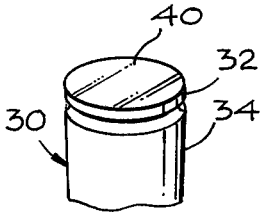
FIGS. 5A and 5B are respectively a perspective view and a side view of the rearward portion of the round of FIG. 2, showing a second particular arrangement in accordance with the invention.
Figure 5B:
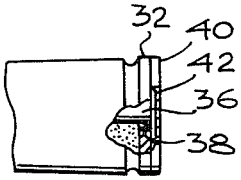

FIGS. 5A and 5B illustrate a second embodiment of the invention which utilizes a layer of conductive paint 40, such as is described in connection with the embodiment of FIGS. 4A and 4B, together with a layer of non-conductive or insulating paint 42 provided over the central portion of the base 32 and underneath the conductive layer 42. This insulating layer 42 is of sufficient extent to completely encompass the accessible surface of the primer cap 36 and the insulation ring 38. In this embodiment, therefore, the conductive layer 40 does not make electrical contact with the primer cap 36. The results are similar to those provided by the embodiment of FIGS. 4A and 4B, in that static charges cannot be applied to the primer cap 36 and the primer cap is shielded from ambient radiation in the manner described. The insulating layer 42 serves to limit the proportion of current which may be bled off through the conductive layer 40 when the firing pulse is applied, and the insulating layer 42 also protects the primer cap 36 from any adverse effect from possible induced circulating currents which might be present in the conducting layer 40. The insulating layer 42 may comprise any of a number of insulating coatings known in the art for application in liquid form; the varnish which is used for coating the copper wire of RF inductance coils is admirably suited for this purpose.

Third Embodiment

Figure 6A:
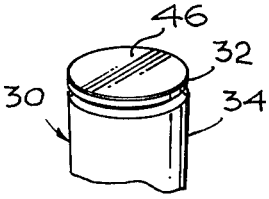
FIGS. 6A and 6B are respectively a perspective view and a side view of the rearward portion of the round of FIG. 2, showing a third particular arrangement in accordance with the invention.
Figure 6B:
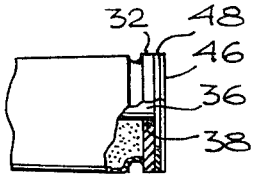

FIGS. 6A and 6B depict still another arrangement in accordance with the invention in which the base 32 of the round 30 is covered with a thin layer of metal foil 46. As shown in particularly in FIG. 6B, the layer 46 is affixed to the surface of the base 32 by means of a ring of conductive adhesive 48 applied to either the base 32 or the foil 46 before the two are joined together. In this arrangement, the foil 46 extends over the primer 36 and insulation ring 38 without necessarily making electrical contact with the primer cap 36. The foil may be in the range of 0.1 to 1.0 mils or even less. The thickness is preferably selected so that the foil layer fuses open or burns back from contact with the firing pin when the latter is moved in to puncture the foil layer and impact the primer cap 36 as the firing pulse is applied. A foil layer 46 of the type described serves effectively in shielding the primer cap 36 from the effects of ambient electromagnetic radiation because of the aforementioned skin effect, and also serves to protect the round against ignition from applied static electrical charges.

Figure 7A:
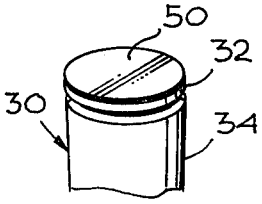
FIGS. 7A and 7B are respectively a perspective view and a side view of the rearward portion of the round of FIG. 2, showing a variation of the arrangement of FIGS. 6A and 6B.
Figure 7B:
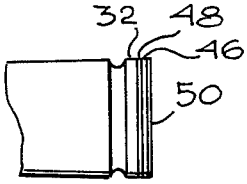

FIGS. 7A and 7B illustrate a variation of the embodiment of FIGS. 6A and 6B, in that the foil layer 46 is supported on flexible, tough carrier or substrate 50, such as Mylar or the like. The manner of application by means of the ring of conductive adhesive 48 is the same as shown in FIG. 6B. Use of foil backed by Mylar or the like in the fashion shown in FIG. 7B permits a thinner layer of the foil 46 to be utilized and it also accommodates to the use of a metal layer which may be prepared by vapor deposition on the substrate 50.

Figure 8:
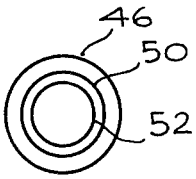
FIG. 8 is a view of the forward side of a foil layer which may be substituted for that of FIG. 7B.

FIG. 8 shows a variant combination of a foil layer 46 and carrier 50 in which the carrier 50, of Mylar or the like, may be mounted between the foil 46 and the surface of the base 32 to serve as insulation in the region of the primer cap 36. The ring 52 indicates the extent of the conductive adhesive 48, the adhesive being applied from the ring 52 outwardly to the edge of the foil 46 to insure a conductive path from the foil 46 to the base 32.

Figure 9:
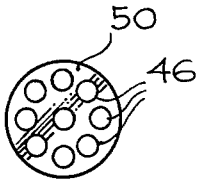
FIG. 9 is a view of the rearward side of the foil layer of FIG. 7B.

FIG. 9 shows details of the foil 46 and carrier 50 of FIG. 7B in which the foil 46 is mounted adjacent the surface of the base 32 with the carrier 50 serving as a protective layer over the outside thereof. In this arrangement, the carrier 56 may be a webbed or apertured layer with openings such as are shown in FIG. 9 exposing portions of the foil 46. This arrangement permits actual physical, electrical contact of the foil 46 through the openings to the grounding fingers which handle the rounds 30 as they are being transferred from the magazine drum 22 to the breech of the gun assembly 14.

Arrangements in accordance with the present invention effectively protect the rounds of ammunition with which they are associated from the inadvertent ignition of the ammunition from ambient radiation and static charge buildup. The conductive layers provided in accordance with the various embodiments of the invention are simple, economical, reliable, and easy to apply, either during the manufacture of the ammunition or in retrofitting existing ammunition. They are effective in solving the problem of radiation hazard which has not been eliminated by more complex devices developed specifically for the problem herein described. Moreover, they protect the ammunition against firing from ambient radiation after an unfired round is returned to the magazine.

Although there have been described above specific arrangements of an electromagnetic hazard suppression technique in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A shield for an ammunition round fabricated for electrical ignition, the round having a metal base and casing with an opening in the base for locating a primer therein, comprising:

a conductive layer extending along the base and covering said opening; and means for conductively affixing the conductive layer to the base in electrical circuit therewith.

2. The device of claim 1 wherein the conductive layer is also in electrical contact with the primer within the opening.

3. The device of claim 1 wherein the conductive layer comprises a layer of conductive paint applied over the base of the round.

4. The device of claim 3 further comprising a non-conductive layer extending underneath the conductive layer over a limited extent of the base immediately surrounding the opening and extending across the opening and primer therein.

5. The device of claim 1 wherein the conductive layer comprises a thin metal foil affixed to the base about at least the periphery thereof.

6. The device of claim 5 wherein the conductively affixing means comprises a layer of conductive adhesive applied between the foil and the base and extending completely around said opening.

7. The device of claim 5 further comprising a carrier layer supporting the foil layer and to which the foil layer is attached.

8. The device of claim 7 wherein the carrier layer is Mylar and is applied to the radially inward portion of the foil to effect a layer of insulation over the opening and immediate surrounding area of the base, and including a ring of electrically conductive cement affixing the outer periphery of the foil layer to the surface of the base and overlapping the outer periphery of the Mylar layer.

9. The device of claim 5 wherein the foil layer is attached to a webbed backing layer, the foil layer being positioned between the backing layer and the surface of the base, the conductively affixing means comprising a ring of conductive adhesive extending between the foil and the base, completely around and spaced from the opening.

10. The device of claim 5 wherein the foil is of a limited thickness such that the circuit through the foil fuses open upon the application of a firing pulse from an associated firing pin.

11. The device of claim 2 wherein the conductive layer provides a conductive path between the primer and the casing which is approximately ten times the resistance of the primer.

12. The device of claim 11 wherein the resistance of the path between the primer and the casing is approximately 10 ohms.

13. A radiation shielded ammunition round comprising:

a casing supporting a projectile at its forward end and having a metal base at the rearward end;

a primer cap inserted in an opening in the metal base, the primer cap being adapted for ignition by an electrical firing pulse;

an insulation ring positioned between the primer cap and the base to maintain electrical isolation between the two;

a conductive layer extending along the base and covering the primer; and means conductively affixing the conductive layer to the base in electrical circuit therewith.

14. The round of claim 13 wherein the conductive layer is in electrical contact with the primer.

15. The round of claim 13 wherein the conductive layer comprises a layer of conductive paint applied over the base of the round.

16. The round of claim 15 further comprising a non-conductive layer extending underneath the conductive layer between the primer and the conductive layer.

17. The round of claim 13 wherein the conductive layer comprises a thin metal foil affixed to the base about the periphery thereof and extending across the primer and the insulation ring.

18. The round of claim 17 wherein the conductively affixing means comprises a layer of conductive adhesive.

19. The round of claim 18 further comprising a carrier layer supporting the foil layer and to which the foil layer is attached.

20. The round of claim 19 wherein the carrier layer is Mylar and is applied to the radially inward portion of the foil to provide a layer of insulation over the primer and the region immediately surrounding the insulation ring, and further including a ring of electrically conductive cement affixing the outer periphery of the foil layer to the surface of the base and overlapping the outer periphery of the Mylar layer.

21. The round of claim 13 wherein the conductive layer provides a conductive path between the primer and the casing which is approximately ten times the resistance of the primer.

22. The round of claim 21 wherein the resistance of the primer is approximately 1 ohm and the resistance of the path between the primer and the casing is approximately 10 ohms.

* * * * *